United States Patent [19]

Edwards

[11] 4,079,880

[45] Mar. 21, 1978

[54] PLASTIC FOOD PACKAGE

[75] Inventor: Richard Thomas Edwards, Middletown, N.Y.

[73] Assignee: Polysar Plastics, Inc., Middletown, N.Y.

[21] Appl. No.: 765,390

[22] Filed: Feb. 3, 1977

[51] Int. Cl.[2] ..... B65D 45/00; B65D 45/20

[52] U.S. Cl. ..... 229/45 R; 229/2.5 R; 220/315; 220/339; 220/306

[58] Field of Search ..... 220/339, 306, 307, 315, 220/DIG. 12, DIG. 14; 229/43, 44 R, 45, 2.5 R; 206/278, 508; D89/1 R, 15 C, 15 R; D9/182

[56] References Cited

U.S. PATENT DOCUMENTS

| | | | |
|---|---|---|---|
| 3,767,110 | 10/1973 | Congleton | 229/45 |
| 3,942,707 | 3/1976 | Schidlowski et al. | 229/2.5 R |
| 3,977,595 | 8/1976 | Hillgenberg | 229/2.5 R |

*Primary Examiner*—George T. Hall
*Attorney, Agent, or Firm*—Stevens, Davis, Miller & Mosher

[57] ABSTRACT

A plastic food package of base and lid components which have a locking means comprising a locking projection which is stiffened and a locking flap lockingly engagable with the projection. The locking projection in practical constructions is formed by projecting walls which meet to form a peak whereby the projection is stiff. The projection is rigidly held to its component by a stiffening shoulder which supports the projection and itself merges with a sidewall of the component along a junction region which is orientated to prevent movement of projection relative to component. The flap has an aperture and the peak of the projection has to pass through the aperture to lock the flap in a locking position. To effect passage of the peak through the aperture, one of the components needs to be flexed to move the peak into alignment with the aperture. In the locking position, the flap is prevented from returning to an unlocked position because of the peak and the flap lies in the direction of opening of the package to provide greatest resistance to distortion.

8 Claims, 10 Drawing Figures

FIG. 4.
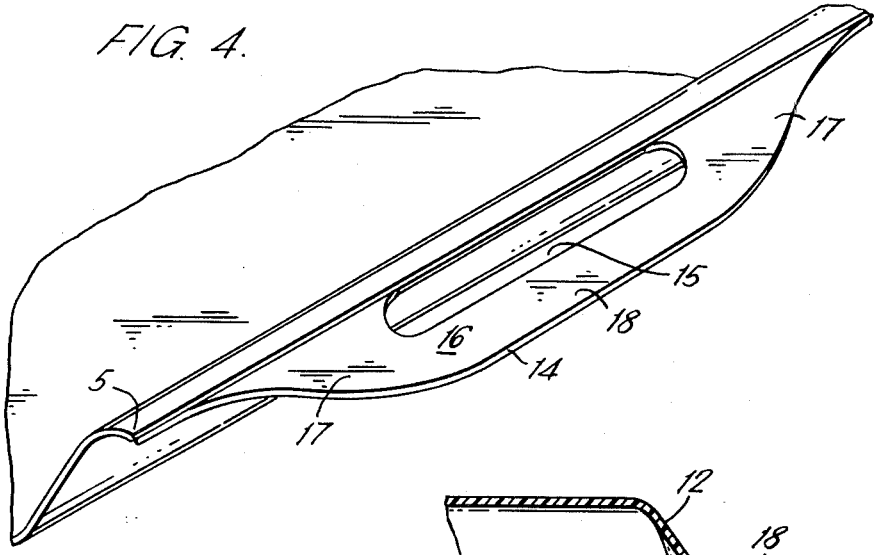
FIG. 5.
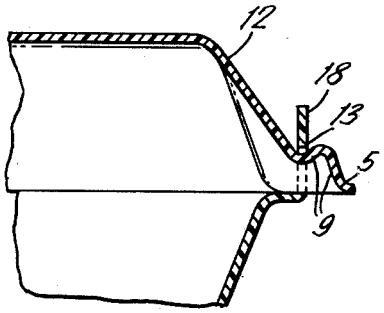
FIG. 9.
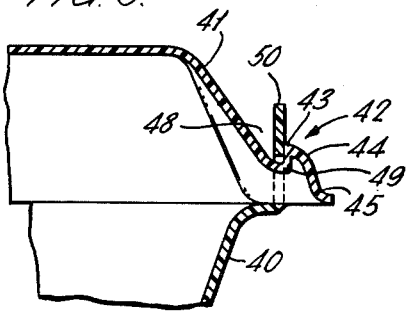
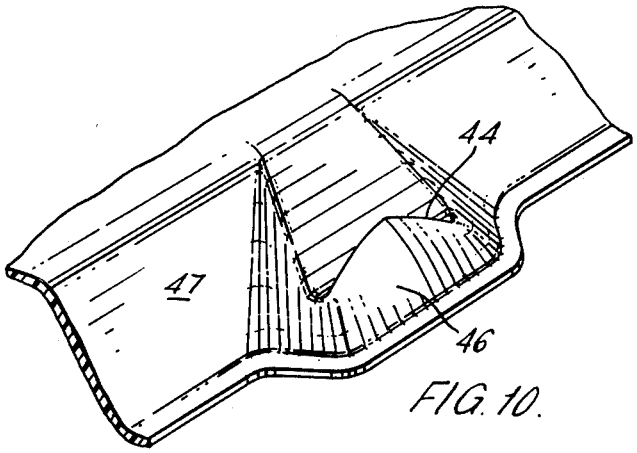
FIG. 10.

PLASTIC FOOD PACKAGE

This invention relates to plastic food packages. It is particularly concerned with packages formed from foamed thermoplastic materials but is also applicable to ones made from non-foamed plastics such as high impact polystyrene.

Plastic food packages in use at the present time which incorporate food trays or base components and lid components also have locking means, the purpose of which is to hold the lid components closed upon the base components. In cases where non-foamed material is used, the locking means are sometimes satisfactory in providing a positive closure retaining effect, but such positive action is simply the result of the inherent stiffness and rigidity of the basic plastic material. When food packages are made from foamed thermoplastic, while the base and lid components may be sufficiently rigid to serve the purpose for which they are intended, locking means incorporated therewith tend to be particularly flimsy and not very positive and definite in their operation. In most of the locking means, a slot is provided in one component and this coacts with a flap on the other component which is inserted through it when the components are closed together. This results in a mere interference between the sides of the slot and the flap and the flexibility and inherent lack of strength of the foamed thermoplastic results in sloppiness of fit of the parts of the locking means particularly as a force applied to the parts of the locking means acts transversely to the plane of the foam material surrounding the slot.

In contrast, the present invention is concerned with a food package in which the locking means is novel in that it includes a locking projection on one of the components of the package, the projection having a stiffening means which resists flexing of the projection relative to the rest of the component. The other component has a flap which is formed with an aperture to provide a flap aperture border around at least part of the aperture, the flap being pivotable to pass over the projection which has a peak which lies in the path of the flap border. According to the invention, the projection is moved to allow the peak to pass through the aperture by resilient flexure of one of the components. After the peak has passed through the aperture, the peak then returns to its normal position in line with the return path of the flap border so as to hold the border in a package locking position. In this position, the flap extends from its pivotal axis in a direction generally in the direction of the initial opening movement of the components. Because of this, any force applied in the opening direction is transmitted by the projection to the flap border at an edge of the border defining the aperture whereby this force is taken upon the flap in the plane of the aperture and of the flap border. Clearly, the flap border is wider than its thickness whereby its rigidity and strength are substantial. In view of this and also because of the use of the stiffening means for the projection, little or no flexibility is possible in the locking means which, therefore, is effective to hold the package tightly closed against any normal forces applied in the opening direction.

Although it may be undesirable to require the package to be reuseable for foodstuffs, it is advantageous in the construction of the invention to be able to return the flap out of its package locking position to an unlocked position as the package may then be closed and opened more than once when in actual use. To enable this to be done, clearly it is convenient to remove the peak of the projection from the path of the flap aperture border by resiliently flexing one of the components. Alternatively, where it is intended that the package should be locked once only, the projection may be designed to allow only for one way movement of the flap, i.e. into its locking position, in which case breakage of the flap or projection is necessary to open the package.

The shapes of projection and stiffening means may take any form which provides the required function. Preferably, the projection is a wall extending from the rest of its component, but for reasons of strength and stiffness should be a rib conveniently formed by two spaced walls joined at the top to form the peak. The projection formed in this way as a rib has its own inherent stiffness which assists in providing a robust and rigid locking means.

The stiffening means is preferably constructed according to basic engineering principles. To effect rigidity in a case where the package is formed from sheet plastic by thermoforming techniques, the stiffening means must be particularly resistant to bending towards the opening direction of the package. One construction providing sufficient resistance to bending in this fashion is of particular relevance to a component which has sidewalls and an end wall extending across the sidewalls to close the interior space at one end. The stiffening means is conveniently in the form of a shoulder which stands out from and has a depth extending down a sidewall and has a junction area with the sidewall which extends for part at least of its depth and the projection is an extension of the shoulder towards the end wall and is spaced from the sidewall to form a recess in which to locate the flap aperture border in its locking position. With this construction, the required stiffness of the shoulder is provided while making it possible to form the shoulder and sidewall from a single sheet of material with the sidewall merging into the shoulder.

Embodiments of the invention will now be described by way of example, with reference to the accompanying drawings, in which:

FIG. 4, is a view similar to FIG. 3 of another part of the locking means;

FIG. 5, is a vertical cross-sectional view through part of the package of FIG. 1 showing the locking means on a larger scale than in FIG. 1;

FIG. 9, is a cross-sectional view through part of a package of a third embodiment showing a locking means in locked position; and FIG. 10, is an isometric view of part of the locking means of FIG. 9.

Figure 1:
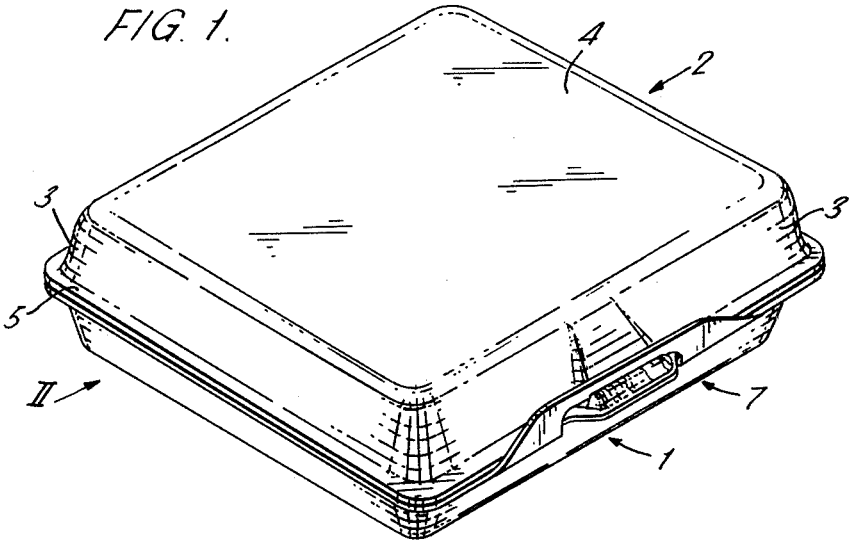
FIG. 1, is an isometric view of a package according to a first embodiment in a closed and locked position.
Figure 2:
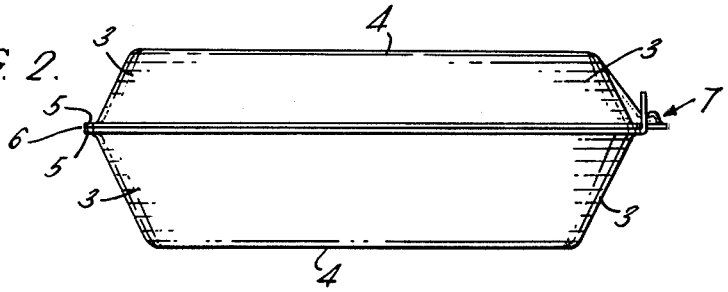
FIG. 2, is a side elevational view of the package of FIG. 1 in the direction of arrow II in FIG. 1.
Figure 3:
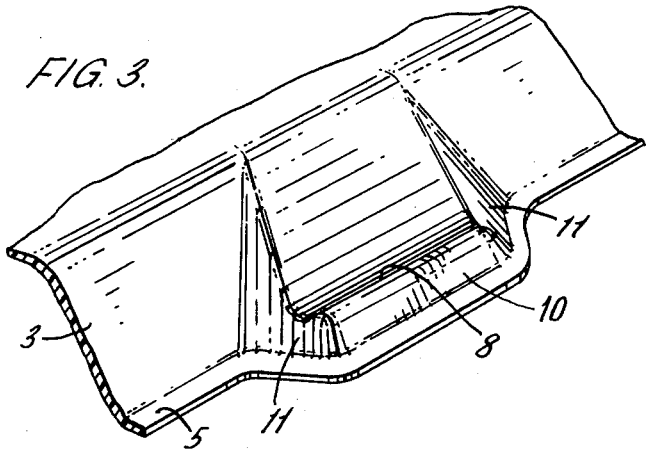
FIG. 3, is an isometric view of part of a locking means of the package of FIG. 1 and on a larger scale than FIG. 1.

In a first embodiment as shown in FIGS. 1–5, a food package is made by a thermoforming process from foamed polystyrene sheet material. As shown from the general view of FIG. 1, the package comprises a base component 1 and a lid component 2. Each component is of general square shape in plan view and comprises four sloping sidewalls 3 which converge upon a base or end wall 4. The end wall 4 of each component forms a closure at one end of an interior space defined by the sidewalls. At the other end of this space the sidewalls define an opening for allowing the container component to be placed over food to be carried in the package. At the opening, the sidewalls terminate in an outstanding surrounding lip 5 which provides a stiffening function to the component. The two components are thermoformed integrally and are joined together along one sidewall 3 by a thermoformed hinge 6 (see FIG. 2 particularly).

The package is also provided with a locking means for holding the components together in a closed position of the package. This locking means, generally indicated by numeral 7, is disposed upon the two sidewalls of the components directly opposite to the hinge 6. On the lid component, the locking means comprises a locking projection in the form of a rib 8 (FIGS. 3 and 5 particularly), the rib extending alongside and spaced from its associated sidewall 3. The rib has a peak 8 facing in the direction of end wall 4 and as shown by FIG. 5 is formed with two spaced walls 9 which taper towards the peak and away from a shoulder 10 which protrudes outwardly from the sidewall. As can be seen from the drawings, the rib merges smoothly with the shoulder 10. The shoulder 10 extends upwardly from the lip 5, i.e. towards end wall 4, and a closing wall 11 is provided at each end of the shoulder, the wall 11 extending upwardly to close the ends of the rib 8 so that a particularly stiff and robust thermoformed rib and shoulder construction is provided. The shoulder extends from the lip 5 towards the end wall 4 of the lid component for a short distance with the rib 8 extending further towards the end wall. The shoulder is joined to the sidewall 3 by means of a buttress formation 12 thermoformed outwardly from the sidewall so that the shoulder 10 is joined to the sidewall down the depth of the shoulder, i.e. in a direction towards the end wall 4. Between the rib 8 and the buttress formation 12 is provided a recess 13 which is closed at one end by the shoulder 10 and is open towards the end wall.

The locking means also comprises a locking flap which is thermoformed upon the base component 1. The locking flap 14 is hinged about a pivotal axis at the free end of the lip 5. The flap has an aperture 15 defined by a flap aperture border 16 of the flap. The flap is elongate along one side of the pivotal axis and is of such dimensions that upon pivoting the flap from a normal position in which it lies substantially in the plane of the lip 5 through an angle of approximately 90°, the aperture will pass over the shoulder 10 and rib 9 of the lid component. The flap aperture border comprises two arms 17 extending from the pivotal axis and abridging piece 18 which extends along the long side of the aperture 15 remote from the axis. With the flap in the position shown in FIG. 5 which is the package locking position of the flap, the bridging piece 18 lies in the recess 13 provided between the projection 9 and the buttress 12.

In use of the package, when food is placed inside the base component 1 and the lid component is closed upon the base component, the two components are locked together with the locking means. The flap of the locking means is pivoted from its position shown in FIG. 4 into the position in FIG. 5 with the flap aperture border in the locking position. To achieve this, it is necessary for the peak and the projection 9 to pass through the aperture 15. However, the design of the locking means is such that the peak in the normal position of the projection lies in the path of the bridging piece 18 so that it is not completely free to pass through it. To enable the peak of the rib 9 to pass through the aperture, it is necessary manually to flex the sidewall 3 of either the container base or the lid component so that slight relative movement vertically between the projection and the flap takes place. This causes the peak 9 to pass through the aperture so that the flap passes into the recess 13 thus disposing the peak and the projection from one side of the flap to the other. Alternatively, to locate the flap in the position shown in FIG. 5, it may be found possible to flex the bridging piece 18 slightly to enable it to pass over the peak so that pressure upon the sidewalls 3 may not be necessary.

It is found that when the flap is in the locking position shown in FIG. 5, a particularly robust and stiff lock is provided for holding a package closed. The stiffness and strength of the locking means is, of course, provided completely by the design of the flap and rib and shoulder arrangement and also the direction in which the flap is pointing in its locking position. The rib 9 and the shoulder, while having been formed by a thermoforming process from foam plastic material, are of domed elongate form and are thus of box-type construction which gives particular strength and robustness to the construction. Because of this, once the peak of the projection is located with the flap border in the recess 18 there is no natural tendency for the locking means to unlock and a definite step has to be taken before the flap may be returned to its unlocked position as shown in FIG. 4. In order to assist the projection from being pushed back through the aperture in an unlocking movement, the shoulder 10 is joined in the vertical direction towards the end wall 4 of the lid component 2 by the buttress 12. There is, therefore, a very strong resistance to bending of the projection 9 and shoulder 10 upon the sidewall 3 so that the flap cannot merely push the projection downwards from end wall 4, thus preventing flap movement back into the unlocked position. Further to this, as can be seen from FIG. 5, the bridging piece 18 of the flap aperture border extends substantially vertically which means that any force applied to the package in the opening sense will be placed upon the flap in the plane of the aperture and also in the plane of the border 16 so that this force is taken upon the full width of the bridging piece 18 and upon the arms 17. Obviously, the width of the bridging piece and the arms is far greater than the thickness of foam material so that the load imposed is quite easily dissipated throughout the material without distortion or breakage thereof. In contrast to this in conventional constructions, the load is normally taken through the thickness of thermoformed foam material which results in easy breakage of the rather flimsy structure.

The design of the first embodiment is such that removal of the flap out of its locking position is easily provided for by either pressing a sidewall 3 or by slightly distorting the bridging piece 18 so as to enable the bridging piece to pass over the peak 9 as described above.

One further advantageous feature of the above construction is concerned with the elongate rib 9 and aperture 15. Because of this, there is a long line of contact between the bridging piece 18 and the projection when the flap is in its locking position. Furthermore, if a load is placed upon the package in the opening sense then the load is dissipated throughout this line of contact while the bridging piece becomes more deeply settled within the recess 13, thus resisting any tendency for opening movement of the locking means to take place. Apart from this, if the design considerations are correct, then the rib contacts the bridging piece towards the ends of the aperture in addition to along the rest of the aperture so that the load taken into the bridging piece is taken at least partly at the ends of the bridging piece i.e. adjacent the arms 17 so as to reduce the bending movement upon the bridging piece to a minimum.

Figure 6:
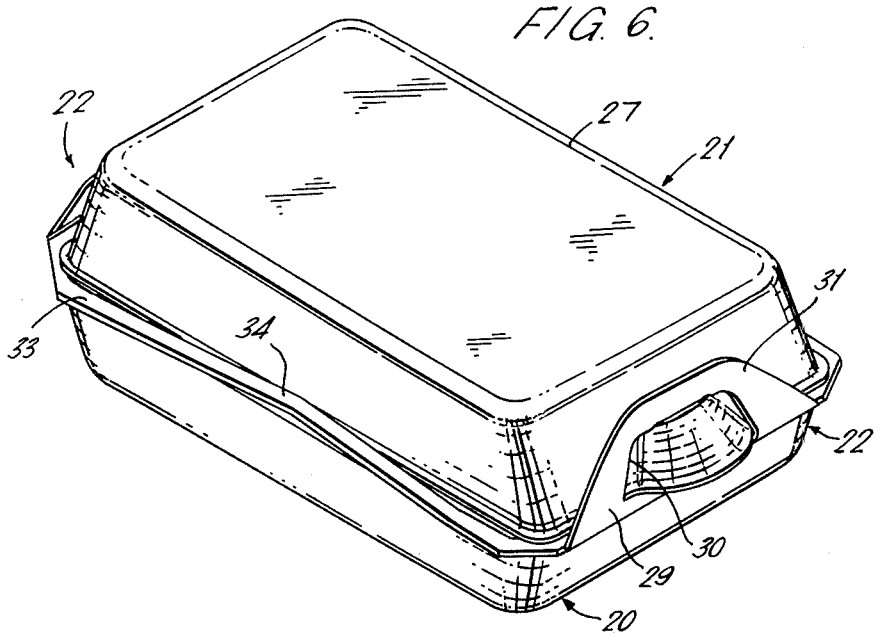
FIG. 6, is an isometric view of a package according to a second embodiment in a closed and locked position.
Figure 7:
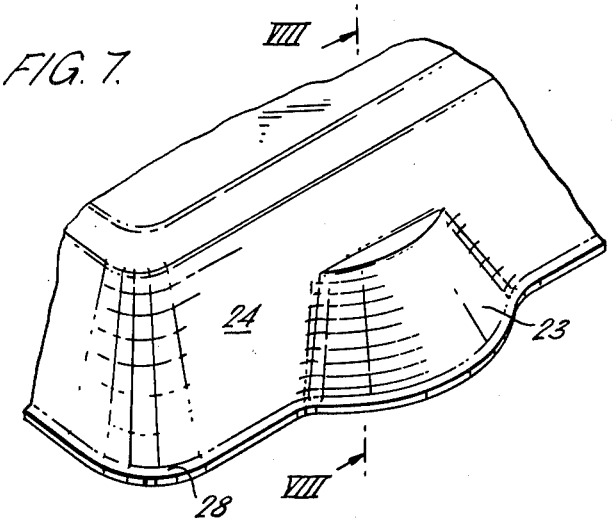
FIG. 7, is an isometric view of part of a locking means of the package of FIG. 6 and on a larger scale.

In a second embodiment as shown in FIGS. 6 and 7, there is provided a food package comprising a base component 20 and a lid component 21. Both of these components are of general rectangular shape in plan view. As can be seen from FIG. 6, the lid component is completely detachable from the base component as it is not hinged to it as in the first embodiment. In this embodiment, the lid component is secured to the base component in the closed state of the package by having two locking means 22 which are disposed at opposite ends of the package and which hold the components together.

Figure 8:
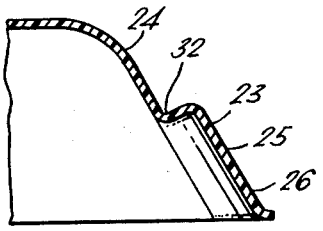
FIG. 8, is a cross-sectional view through the package along section line VIII—VIII in FIG. 7.

Each locking means is basically of the same construction and operation as in the first embodiment. As can be seen from FIGS. 7 and 8, the locking means has a locking projection 23 of elongate form extending alongside and spaced from one sidewall 24 of the lid component 21. The projection is in the form of a rib again formed from two converging sidewalls 25 which terminate in a peak facing towards a base 27 of the lid and blend into a shoulder 26 which itself extends towards the base from a sidewall 28 which surrounds the opening to the lid component. The shoulder 26 is thermoformed outwardly from the sidewall 24 and is joined thereto down the depth of the shoulder so as to resist pivoting movement of the peak and the shoulder relative to the sidewall as in the first embodiment.

Each locking means also comprises a flap upon the base component 20, the flap being of construction similar to that of the first embodiment and having a flap aperture border 29 which defines an aperture 30. The aperture 30 is of sufficient size for it to pass over the shoulder 26 and the projection 23 for location of a bridge piece 31 of the flap in a recess 32 formed between the projection 23 and the sidewall 24.

As in the first embodiment, the peak of the projection 23 normally lies in the path of the bridge piece 31 of the flap. However, when the two components are assembled together each flap is passed from a normally horizontal position i.e. in alignment with a surrounding lip 33 of the base component and into a substantially vertical or package locking position as shown in FIG. 6. Hence, to move each flap into this position it is necessary either to flex the bridge piece 31 slightly or to manually push a sidewall 24 of either the base component or the lid component sufficiently for distortion to take place of the sidewall to move the flap or the projection to enable the peak of the projection to pass through the aperture. Once the flap is in its locking position as shown in FIG. 6, then the stiffness and rigidity of the projection, sidewall and shoulder of the lid component and also in the plane of the flap 31 is sufficient to prevent the flap from moving out of its locking position unless positive steps are taken to achieve this. In fact, if an opening force is applied to the two components, then each flap merely embeds itself further into its recess 32 thereby increasing its locking action.

With the construction in the second embodiment, similar advantages are obtained as in the first embodiment.

The second embodiment has a means for initial location of the components together before the locking means are operated to hold the assembly closed. As can be seen from FIG. 6, a surrounding lip 33 of the base component stands outwardly from the lip 28 of the lid component and the locating means takes the form of an upwards deformation of the edge of the lip 33 on each side of the base component. This upwards deformation 34 results in a sloping downwards of the lip 33 as it extends towards the opening of the base component so that the lid component may easily be located in exactly the correct position to enable the flaps of the locking means to be disposed over the projections 23 and into the grooves 32.

In a third embodiment as shown in FIGS. 9 and 10, a small food package has a locking means of smaller construction than those described in the first two embodiments. Briefly, the package has a base and lid components 40 and 41 basically of the same construction as in the first and second embodiment in that there are sidewalls and end walls provided. In this construction, a locking means 42 is provided by a projection 43 which has a ridge 44 extending outwardly at 90° to the sidewall while it extends towards the lip 45 of the lid component so as to reduce the height of the projection. The projection blends into a shoulder 46 which stands outwardly from the lip and merges with its adjacent sidewall 47. The projection 43 is thermoformed so as to provide a recess 48 between the projection and the adjacent sidewall 47. As shown particularly in FIG. 9, the thermoforming operation also forms a substantially vertical wall 49 in the projection which faces across the recess 48. With this construction, therefore, the vertical wall 49 acts as an abutment for the locking flap 50 which is pivotally mounted on the base component 40 in a manner similar to that described in the first and second embodiment. This construction differs, therefore, from the earlier embodiments in that there is less area of contact between the projection and the flap.

What is claimed is:

1. A food package comprising a container base component and a container lid component, both formed from foamed plastic material and in which:

(a) one of the components has sidewalls to define an interior space closed at one end by an end wall extending across the sidewalls, an opening to the space being defined between the sidewalls at a position spaced from the sidewalls from the end wall;

(b) the two components having a locking means to hold them closed together, said locking means including:

(i) a shoulder standing outwardly from a sidewall of said one component, the shoulder extending along the sidewall towards the end wall and being integral with the sidewall for at least part of the distance along the sidewall to stiffen the shoulder upon the sidewall;

(ii) a locking projection extending from the shoulder and along the sidewall towards the end wall and terminating in a peak, the projection being spaced from the sidewall to form a recess which is open towards the end wall; and (iii) a locking flap formed from the other component, the flap having a border defining an aperture and being pivotally mounted about a pivotal axis on the other component;

(c) with the components closed together, the projection extends from the shoulder away from said other component and the flap is pivotal into a package locking position by passing it around the projection and the shoulder so as to dispose the peak and part of the shoulder through the aperture from one side to the other of the flap, the peak being allowed to pass through the aperture by resilient flexure of one of the components; and (d) the flap in its locking position having its border located in the recess with the flap and its border extending from the pivotal axis towards the end wall of said one component while passing around the shoulder and into the recess and with the border thereby extending outwardly of the recess towards said end wall to locate the flap and border extending in the general direction of opening movement of the components to transmit any force tending to open the components from the recess to the border in a direction radially outwardly from the pivotal axis of the flap and in the plane of the border.

2. A food package according to claim 1 wherein said one of the components is also flexible to enable the flap to be moved out of the package locking position and allow opening of the package.

3. A food package according to claim 1 wherein the flap aperture border defines an elongate aperture in a direction transverse to the direction of opening movement of the package, and the projection is correspondingly elongate so as to afford a line contact between the projection and the flap aperture border when the flap is in its package locking position and a force is applied to the package in the opening sense.

4. A food package according to claim 1 wherein the flap aperture border comprises two arms extending from the pivotal axis and spaced-apart by the aperture, and a bridging piece extending across and interconnecting free ends of the arms, the projection and flap coacting when the flap is in its package locking position, to transmit load from the projection to the bridging piece in positions adjacent the two arms when a force is applied to the package in the opening sense so as to minimize any bending movement upon the bridge piece.

5. A food package according to claim 1 wherein the two components are completely detachable one from the other and two locking means are provided and are disposed in remote positions from one another, the two components being capable of assembly by placing them together to close the package and the locking flaps of the two locking means are moveable to their locking positions over their associated locking projections to hold the components together.

6. A food package according to claim 1 wherein the flap aperture border defines an aperture which is elongate in a direction transverse to the direction of opening movement of the package and the projection is elongate and is in the form of a rib extending alongside and spaced from the sidewall so as to afford a substantial line contact between the projection and the border when the flap is in its package locking position and a force is applied to the package in the opening sense.

7. A food package according to claim 6 wherein the rib is formed by two spaced walls joined at the tops of the walls to form the peak.

8. A food package according to claim 1 wherein the two components are integrally joined together by a hinge at a sidewall of said one component opposite to the locking means, the locking projection and its recess are elongate in a direction substantially parallel with the axis of the hinge, the pivotal axis of the flap is also substantially parallel with the hinge axis, and the flap aperture border defines an aperture which is elongate correspondingly to the locking projection and recess.

* * * * *